United States Patent [19]

Kulesza et al.

[11] 4,304,064

[45] Dec. 8, 1981

[54] TOY SPINNING TOP

[75] Inventors: Ralph J. Kulesza, Chicago; Harry Disko, South Barrington, both of Ill.

[73] Assignee: Marvin Glass & Associates, Chicago, Ill.

[21] Appl. No.: 114,975

[22] Filed: Jan. 24, 1980

[51] Int. Cl.[3] ..... A63H 1/06

[52] U.S. Cl. ..... 46/68

[58] Field of Search ..... 46/68, 50, 67, 69, 70, 46/71, 72, 47, 48, 49

[56] References Cited

U.S. PATENT DOCUMENTS 2,980,423 4/1961 Parkhurst ..... 46/68 X 3,348,334 10/1967 Reynolds ..... 46/68 X

FOREIGN PATENT DOCUMENTS 333619 5/1919 Fed. Rep. of Germany ..... 46/47

*Primary Examiner*—Gene Mancene

*Assistant Examiner*—Mickey Yu

*Attorney, Agent, or Firm*—Mason, Kolehmainen, Rathburn & Wyss

[57] ABSTRACT

A spinning toy or top includes a hollow rotating body with a generally low center of gravity caused by a mass positioned near the bottom of the body and having a portion thereof extending through the lower wall of the body to define a point on which the toy spins. A pair of limbs may be pivotally mounted on the top to be raised or otherwise actuated by centrifugal force upon rotation of the top. A head or similar device may be positioned on the body and coupled thereto for concurrent rotation by frictional forces. The toy is spun by a spinner that includes an elongated screw fabricated in a helical configuration. A handle is secured to the top of the screw and a clutch is mounted on the lower end. The clutch includes a gripping member slidably mounted on the screw so as to rotate when moved relative to the screw. The head member includes a detent mechanism so that the head can be held in a stationary position, or selectively stopped by engagement with the handle.

11 Claims, 4 Drawing Figures

TOY SPINNING TOP

BACKGROUND OF THE INVENTION

1. Field of the Invention

The present invention generally relates to a new and improved spinning toy such as a top or the like.

2. Brief Description of the Prior Art

Younger children are particularly attracted to and entertained by action toys that require selective actuation by the child. One such toy that has been enjoyed by children for many years is the top. There are many ways for actuating prior art tops, such as by pulling a string, spinning with the fingers or by using a helical plunger or stem. It is desirable, however, that in addition to the ordinary top, there be additional action to provide prolonged entertainment for the child. Preferably, the action can be selectively actuated by the child during the rotation or spinning of the top. Certain prior art tops have accomplished entertaining action through the use of whistles and similar noise-making devices or placement of objects within the top that can be observed by the child during the spinning of the top.

SUMMARY OF THE INVENTION

An object of the present invention is to provide a new and improved spinning top including centrifugally actuated components.

Another object of the present invention is to provide a new and improved top including a face or head member that may be selectively spun with the top or stopped in a preselected position while the top continues to rotate.

The present invention is directed to a new and improved spinning toy commonly referred to as a top that includes a hollow body member within which is provided a heavy mass an extension of which extends through a lower portion of the housing to define a point on which the top spins. One or more centrifugally actuated members are pivotally connected to the body and a head is frictionally mounted on the top of the body.

A spinning member or plunger of a helical configuration extends through the head and into the body and is provided with a handle on the top end. A clutch means is mounted on the actuation member so that the helical portion thereof extends through a slot in the clutch. Upon movement of the plunger into the body, the clutch engages the mass and rotation is imparted to the body.

A head member rotates with the body until a detent defined on the head member engages an extension defined on the handle thereby stopping the head portion in a preselected position while the top continues to spin. As the speed of the top increases, the centrifugally actuated members extend outwardly.

The handle may be lifted relative to the head member disengaging the extension and detent and allowing the head member to rotate with the body. Further, the handle may be selectively pushed downwardly to engage the extension and detent to stop rotation of the head relative to the body and this cycle can be repeated as the child operating the toy or the top desires.

BRIEF DESCRIPTION OF THE DRAWINGS

The above and other objects and advantages and novel features of the present invention will become apparent from the following detailed description of the preferred embodiment of the invention illustrated in the accompanying drawings wherein.

DESCRIPTION OF THE PREFERRED EMBODIMENT

Figure 1:
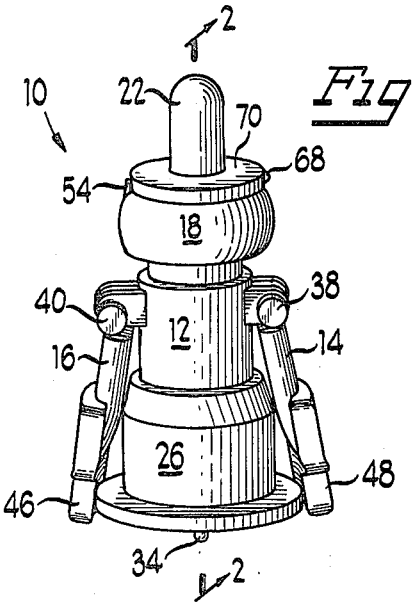
FIG. 1 is a perspective view of a top constructed in accordance with the principles of the present invention.

With reference now to the drawings and initially to FIG. 1, there is illustrated a top generally designated by the reference numeral 10, constructed in accordance with the principles of the present invention. The top 10 is intended to provide spinning action and additional motion developed by centrifugal force selectively commenced by the user operating the top 10. As illustrated in FIG. 1, the top 10 includes a hollow body 12 with centrifugally actuated limb members 14 and 16 pivotally attached thereto and maintained in a down position by gravity. A head member 18 that may have a face or similar indicia painted thereon is frictionally mounted on the body member 12. To spin the top 10, a screw means is provided, and generally designated by the reference numeral 20. The screw means or spinner includes a handle 22 on the upper end of a vertically reciprocating helical shaft to be described in detail hereinafter. It is intended that the top 10 be spun by the vertical movement of the spinner 20 so that the limbs 14 and 16 will pivot outwardly from the body 12 in response to the centrifugal force and the head 18 may rotate with the body 12 or remain stationary in accordance with the selected position of the handle 22.

Figure 3:
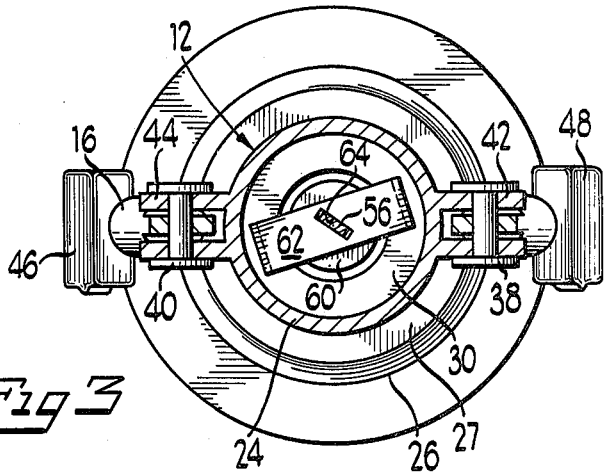
FIG. 3 is a horizontal sectional view taken along lines 3—3 of FIG. 2.
Figure 2:
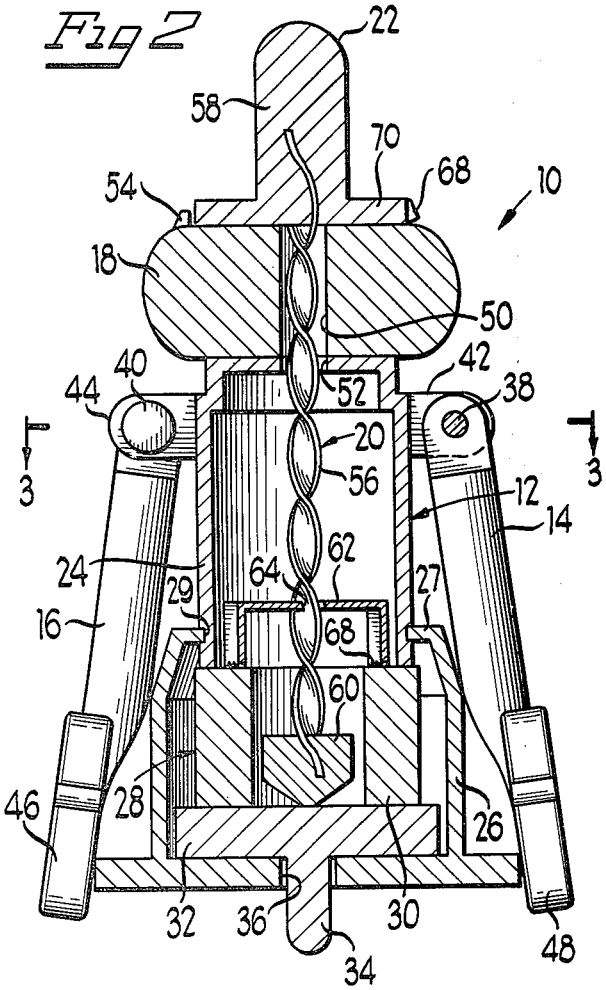
FIG. 2 is an enlarged vertical cross sectional view taken along lines 2—2 of FIG. 1.
Figure 4:
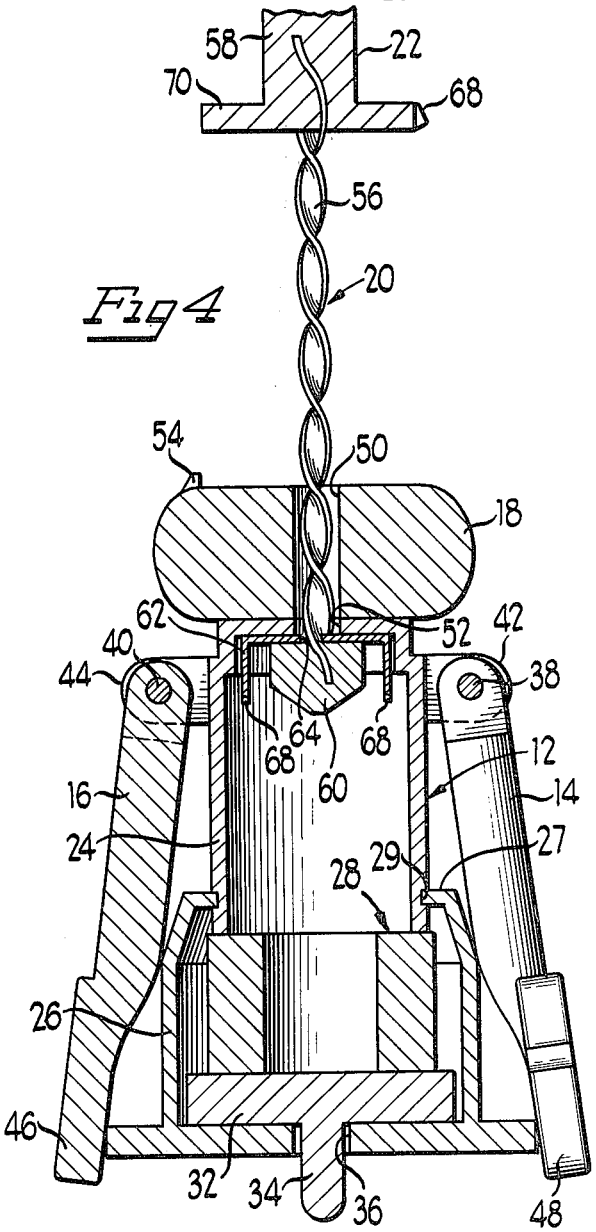
FIG. 4 is a view similar to FIG. 2 with the plunger extending out of the top.

More specifically, referring to FIGS. 2–4, the body 12 of the top 10 is hollow and includes a cylindrical base portion 26, the upper end 27 of which is secured in a groove 29 fabricated in the outer peripheral surface of the upper torso portion 24. A weight or mass, generally designated by the reference numeral 28, is mounted in the base portion 26 and is held in position by engagement with the lower end of the upper torso portion 24. The mass 28 includes an upper annular member 30 and a lower plate or base member 32. The mass 28 may be of any material, but in the preferred embodiment, is of a mass greater than the mass or the weight of the top 10 thus providing balance and increased inertia upon spinning of the top 10. The base member 32 of the weight 28 includes an extension or post 34 that extends through an aperture 36 defined in the bottom wall of the base 26. The post or extension 34 defines the point on which the top 10 spins.

The arms or limbs 14 and 16 are pivotally mounted by pins 38 and 40 to clevises 42 and 44 defined on the topmost end of the upper torso portion 24. This pivotal connection permits swinging or pivoting movement outwardly from the body 12 during spinning of the top 10 due to the influence of centrifugal force. In the preferred embodiment illustrated, the arms or limbs 14 and 16 extend a sufficient length so that their distal ends 46 and 48 extend below the base member 26 and may serve as supports to balance the top 10 in an upright position while the top 10 is not spinning.

The head member 18 is loosely or frictionally positioned on top of the upper torso portion 24 of the body 12 and includes a central aperture 50 therethrough that is aligned with an aperture 52 defined in the upper end of the upper torso 24. The head 18 also includes a detent or raised tab 54 defined on the upper surface thereof. The head portion 18 may include any indicia desired on the outer periphery thereof; however, one preferred indicia is a face on one side of the head portion 18 that corresponds to the theme of the top 10.

A spinner means in the form of a screw or helical plunger is provided to facilitate spinning of the top. The spinner means includes a screw or shaft 56 which extends through the apertures 50 and 52 into the hollow body 12. The spinner shaft 56 is of a helical configuration and includes a handle 58 secured at the upper end of the shaft 56 and a stop member 60 secured at the lower end thereof. A clutch means is provided to connect the spinner to the top. The clutch means includes a grip member 62 having a slot 64 defined therein that is of substantially the same width and transverse dimension as the spinner shaft 56 so as to allow passage of the spinner shaft 56 therethrough, and a pair of gripping ends or sets of teeth 68.

To spin the toy 10, the handle 58 is lifted upward as far off of the head portion 18 as possible (FIG. 4). In this position, the stop 60 abuts against the lower peripheral surface of the gripping member 62 both of which engage the upper end of the upper torso 24. The handle 58 may then be moved downwardly to engage the upper surface of the head 18. As this occurs, the gripping member 62 engages the upper surface of the annular member 30. The gripping member 62 includes a pair of sets of teeth 68 defined on the lower surface thereof that grip the upper surface of the member 30. As can be seen in FIGS. 2 and 3, the gripping member 62 is of similar annular configuration as the weight member 28 so that all of the teeth 68 engage the upper surface of the member 30. As this occurs, continued movement of the handle 58 and the spinner shaft 56 imparts a rotational movement to the gripping member 62. This rotational movement is imparted through the gripping member 62 to the weight 28 and due to the securement with the body 12, the spinning motion is imparted to the body 12 thus spinning the top 10. Due to the frictional engagement between the head 18 and the upper torso portion 24, the head 18 also rotates with the body 12.

Rotational movement continues to be imparted to the gripping member 62 and thus to the top 10 until the stop 60 engages the base member 32 of the weight 28 thereby terminating further downward movement of the spinner shaft. Upon engagement of the stop 60 with the member 32, the handle 58 engages the head 18. The handle 58 includes a rim 70 on which is defined an extension 68. Upon engagement of the handle 58 with the head 18, the head 18 continues to rotate with the body 12 until the detent 54 engages the entension 68. This stops the rotation of the head 18 with the rotating body 12. The child operating the top 10 may lift the handle 58 releasing the engagement of the detent 54 with the extension 68 thereby allowing the head 18 to spin with the body 12. This sequence of action can be repeated causing the face or other indicia on the face portion 18 to alternately rotate and stop providing an entertaining effect. Continued "pumping" of the spinner means will cause the top to spin at an increasing rate of rotation.

Many modifications and variations of the present invention are possible in light of the above teachings. Thus, it is to be understood that, within the scope of the appended claims, the invention may be practiced other than specifically described above.

We claim:

1. A toy spinning top, comprising:

a hollow body;

a mass positioned in the lower portion of said body;

centrifugally movable limb members pivotally mounted on said body;

means for spinning said top including a rotational force transmitting member engageable with said mass and means for rotating said transmitting member upon engagement with said mass, said mass further includes a depending extension defining the point on which said top spins; and a head member positioned on said body to spin therewith by frictional engagement therebetween, said spinning means further including a handle and an extension on said handle, said head member including a detent engageable by said extension.

2. The top claimed in claim 1 wherein said spinning means further includes a helical shaft and said transmitting member includes a slot through which said shaft extends.

3. The top claimed in claim 1 wherein said transmitting member includes a plurality of teeth to grip said mass upon engagement therewith.

4. A spinning toy, comprising:

a body;

a mass mounted in said body;

first and second centrifugally actuated limb members pivotally mounted on said body;

a head member positioned on said body; and means for spinning said toy wherein said spinning means includes a helical shaft and a mass engagement member on said shaft, said mass engagement member including a slot through which said shaft extends, said mass is hollow and said shaft includes a stop member that extends into said hollow mass to allow engagement of said mass engagement member during spinning of said toy.

5. The toy set forth in claim 4 wherein said mass engagement member further includes a gripping surface thereon for gripping said mass and spinning therewith.

6. The toy set forth in claim 5 wherein said shaft includes a handle, said handle includes an extension thereon.

7. The toy set forth in claim 6 wherein said head member includes a detent engageable by said extension.

8. A spinning action toy, comprising:

means defining a body;

a pair of centrifugally actuated limb members mounted on said body;

means for rapidly rotating said body including a spinner means on said body and a pivot member to define the point on which said toy spins, said spinner means further comprises a slide member of a helical configuration, a handle secured to one end and a grip member including a slot through which said slide member extends for engaging said body, said handle includes a generally lateral extension, and a head member loosely mounted on said body, said head member including a detent for engaging said extension.

9. The toy defined in claim 8 wherein said head member is positioned on said body and frictionally engaging said body to spin therewith.

10. The toy defined in claim 8 wherein said limb members are pivotally mounted on said body member.

11. The toy defined in claim 8 including a weighted element, said weighted element comprising a relatively large mass relative to the mass of said toy.

* * * * *